United States Patent [19]

Buhrmaster et al.

[11] Patent Number: 5,052,331

[45] Date of Patent: Oct. 1, 1991

[54] APPARATUS FOR GAS-METAL ARC DEPOSITION

[75] Inventors: Carol L. Buhrmaster, Corning, N.Y.; Denis E. Clark, Idaho Falls, Id.; Herschel B. Smartt, Idaho Falls, Id.

[73] Assignee: The United States of America as represented by the United Sates Department of Energy, Washington, D.C.

[21] Appl. No.: 529,412

[22] Filed: May 29, 1990

Related U.S. Application Data

[62] Division of Ser. No. 423,172, Oct. 18, 1989, Pat. No. 4,970,091.

[51] Int. Cl.[5] ..... B05C 5/04

[52] U.S. Cl. ..... 118/50.1; 118/302; 118/620

[58] Field of Search ..... 118/50.1, 302, 620; 427/34, 37, 38, 192, 201; 75/10.1, 10.18

[56] References Cited

U.S. PATENT DOCUMENTS 4,741,286 5/1988 Itoh et al. ..... 427/34 X
4,769,101 9/1988 Ribeiro ..... 118/50.1 X
4,928,879 5/1990 Rotolico ..... 427/34 X
4,982,067 1/1991 Marantz et al. ..... 427/34 X

*Primary Examiner*—Richard L. Chiesa
*Attorney, Agent, or Firm*—Tyrone Davis; Robert J. Fisher; William R. Moser

[57] ABSTRACT

Apparatus for gas-metal arc deposition of metal, metal alloys, and metal matrix composites. The apparatus contains an arc chamber for confining a D.C. electrical arc discharge, the arc chamber containing an outlet orifice in fluid communication with a deposition chamber having a deposition opening in alignment with the orifice for depositing metal droplets on a coatable substrate. Metal wire is passed continuously into the arc chamber in alignment with the orifice. Electric arcing between the metal wire anode and the orifice cathode produces droplets of molten metal from the wire which pass through the orifice and into the deposition chamber for coating a substrate exposed at the deposition opening. When producing metal matrix composites, a suspenion of particulates in an inert gas enters the deposition chamber via a plurality of feed openings below and around the orifice so that reinforcing particulates join the metal droplets to produce a uniform mixture which then coats the exposed substrate with a uniform metal matrix composite.

27 Claims, 1 Drawing Sheet

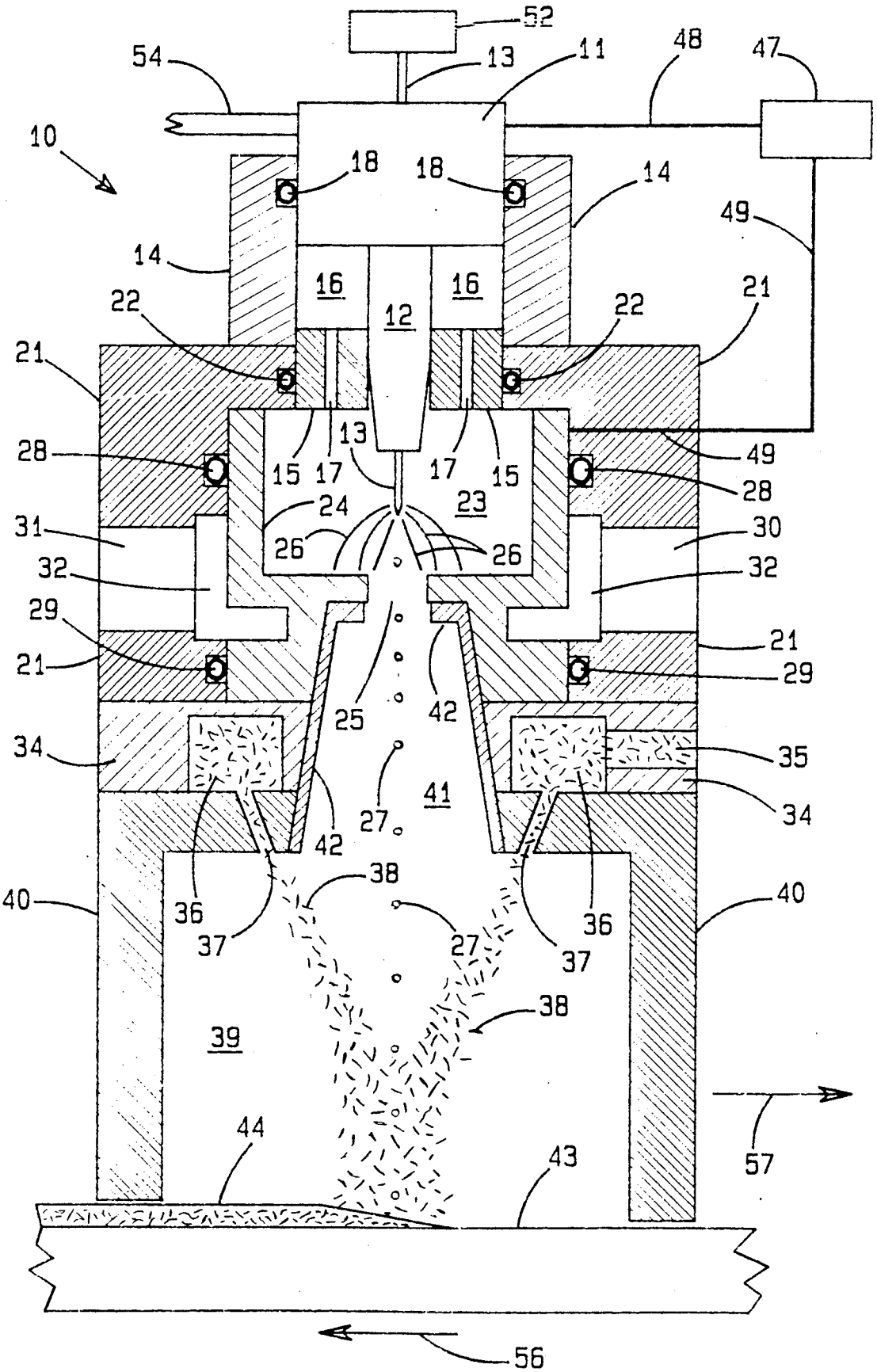
52
54
13
11
48
47
10
18
18
14
49
14
16
16
12
22
22
21
21
13
28
15
17
17
15
49
28
24
23
31
26
26
30
32
32
29
21
21
29
25
42
34
35
41
34
27
42
38
40
36
37
27
36
40
37
38
39
44
43
57
56

APPARATUS FOR GAS-METAL ARC DEPOSITION

CONTRACTUAL ORIGIN OF THE INVENTION

The United States government has rights in this invention pursuant to contract No. DE-AC07-76ID01570 between the U.S. Department of Energy and EG & G Idaho, Inc. representing Idaho National Engineering Laboratory.

This is a division of application Ser. No. 423,172 filed Oct. 18, 1989, Now U.S. Pat. No. 4,970,091.

BACKGROUND OF THE INVENTION

The present invention is a divisional of application Ser. No. 423,112, now U.S. Pat. No. 4,970,091 filed on Oct. 18, 1989, and relates to method and apparatus for deposition of metals, metal alloys and metal-matrix composites upon a substrate. More particularly, the present invention relates to deposition of metals, metal alloys and metal-matrix composites by means of a gas-metal arc deposition process and apparatus.

Aluminum is a widely used structural material which is especially desirable for applications in which high strength to weight ratios are needed. Recent attention has focused on further improving the properties of aluminum alloys by using them as a matrix material in composites. Metal-matrix composites (MMC) have unique mechanical property advantages over pure metals as engineering materials. Materials with high strength and modulus, improved fatigue and wear resistance, and good elevated temperature creep properties can be manufactured, and their properties can be made directional by the appropriate choice of reinforcement shape, volume fraction, and processing. Within the aluminum alloy system, silicon carbide (SiC) is one of the leading reinforcement materials. Aluminum/silicon carbide (Al/SiC) composites are relatively inexpensive and they have high specific strength and specific stiffness that make them candidates for critical aerospace, automotive, and optical applications.

Various techniques are available for coating metals upon a substrate material.

Thermal spraying, also known as flame spraying, involves the heat softening of a heat fusible material such as metal or ceramic, and propelling the softened material in particulate form against a surface which is to be coated. The heated particles strike the surface and bond thereto. A conventional thermal spray gun is used for the purpose of both heating and propelling the particles.

A thermal spray gun normally utilizes a combustion flame, a plasma flame, or an electrical arc to produce the heat for melting of the spray material. It is recognized by those skilled in the art, however, that other heating means may be used as well, such as resistance heaters or induction heaters, and these may be used alone or in combination with other forms of heaters.

The material to be deposited may be fed into the heating zone in the form of powder, or a rod, or wire.

In the wire type of thermal spray gun, the rod or wire of the material to be sprayed is fed into the heating zone formed by a flame or the like, such as a combustion flame, where it is melted or at least heat-softened and atomized, usually by compressed gas. The compressed gas then propels the metal in finely divided form onto the surface to be coated.

In an arc wire spray gun, two wires are melted in an electrical arc which is struck between the wire ends, and the molten metal is atomized by compressed gas, usually air, and sprayed onto a workpiece to be coated. The rod or wire may be conventionally formed as by drawing, or it may be formed by sintering together a powder, or by bonding together the powder by means of an organic binder or other suitable binder which disintegrates in the heat of the heating zone, thereby releasing the powder to be sprayed in finely divided form. In other forms, the wire may have a coating sheath of one component and a core of the others, or it may be made by twisting strands of the components.

Another technique which is suitable for depositing a metal or metal alloy is that of gas-metal arc welding. In gas-metal arc welding, a consumable wire electrode passes through a copper alloy contact tip. Electrical potential applied between the contact tip and the metal to be welded (the base metal) results in a current in the wire which supports an arc between the wire and the base metal. The wire electrode is melted by internal resistive power and heat transferred from the arc. Droplets of molten metal are transferred from the wire to the weld pool of the base metal by a combination of gravitational, Lorentz, surface tension and plasma forces. Heat is transferred to the base metal directly from the arc and also by the molten droplets. Electrode wire, molten droplets, weld pool and solidified weld bead behind the weld pool are protected from oxidation by a shielding gas, such as argon or carbon dioxide. Gas-metal arc welding has been automated by providing means for controlling the rate of filler wire feed and the means for controlling the weld speed (the relative motion between the contact tip and the workpiece). Generally, control of the process has been limited to certain factors which machine builders have been accustomed to, such as the filler wire feed rate, welding speed, current and voltage. These are parameters related to the process.

With this then being the state of the art, it is an object of the present invention to provide a method and apparatus for deposition of metals, metal alloys, and metal-matrix composites upon a substrate.

It is a more particular object to provide a method and apparatus for the deposition of aluminum, aluminum alloys, and aluminum-matrix composites upon a substrate.

These and other objects of the invention, as well as the advantages thereof, will become more clear from the description which follows.

SUMMARY OF THE INVENTION

The method and apparatus described herein provides a new approach to producing near net shape parts having aluminum and aluminum/silicon carbide composite coatings. The apparatus is basically a substantially modified gas metal arc welding torch, in which aluminum wire feed stock is melted for deposition. The melted aluminum wire feed stock can also be combined with silicon carbide reinforcing particulate matter, such as particles, whiskers or fibers, which are entrained in an inert gas. Upon striking a substrate or mold, the aluminum droplets will produce an aluminum coating. If silicon carbide particulates are also present with the aluminum droplets, the aluminum and the silicon carbide particulate mixture solidifies into a coating of a composite structure.

An arc between the end of the aluminum wire and a water-cooled copper cathode produces a stream of droplets having a diameter of about 1 millimeter. Melting rates are of the order of 2 kilograms per hour at approximately 230 amperes. The thermal history of these droplets can be controlled to some extent by the electrical parameters of the melting process, the shielding gas used, and the distance from the orifice to the mold or substrate. Thermal control of the solidification is also affected by the thermal properties of the mold or substrate. Ideally, very little liquid is present at any one time, only enough to bond successive droplets and any silicon carbide reinforcement material which is present. In addition to promoting a desirable rapid solidification, this means that any reinforcement material is not substantially affected by fluid flow and solidification macrosegregation. With appropriate molds and substrates, complex parts and near net shapes with a uniform composite structure may be made. In addition, this process may be developed into a welding process for composites which would provide weld metal of approximately the same composition as the base material, thereby reducing the need for mechanical fasteners and adhesives in the fabrication of large structures.

The modified gas-metal arc torch of this invention is compact, inexpensive, and controllable. Because relatively large droplets are being produced in an inert atmosphere, the pyrophoricity problems associated with finely divided aluminum are greatly reduced.

Accordingly, in one embodiment the present invention comprehends a gas-metal arc deposition apparatus which has an arc chamber body member defining an arc chamber for confining a D.C. electrical arc discharge, the arc chamber body member containing an orifice for discharging ionizable inert gas and molten metal droplets from the arc chamber. A deposition body member defining a deposition chamber is in fluid communication with the arc chamber at the arc chamber orifice. The apparatus also includes a first means for introducing a first ionizable inert gas into the arc chamber and a means for continuously introducing a metal wire into the arc chamber in alignment with the orifice, spaced with the orifice and proximate to the orifice. Means for imposing an electrical charge on the leading end of a metal wire introduced into the arc chamber is also a part of this apparatus, and for imposing a second electrical charge on the arc chamber body member at the orifice. The first and second charges have opposite polarities, to thereby cause arcing between the wire leading end and the edges of the orifice in order to produce droplets of molten metal which pass with inert gas through the orifice and into the deposition chamber. The deposition chamber has a deposition opening spaced from the arc chamber orifice and in alignment therewith, for allowing metal droplets passing through the orifice and into the deposition chamber to coat the surface of a substrate exposed at the deposition opening.

In another embodiment the present invention comprehends the foregoing gas metal arc deposition apparatus which further includes means for supplying a second inert gas containing suspended reinforcing particulate material. A second gas introducing means is positioned to discharge inert gas and suspended reinforcing particulate material into the deposition chamber at an angle sufficient to provide that the suspended reinforcing particulate material will join molten metal droplets to provide a mixture for coating an exposed substrate surface with a uniform coating of metal droplets and reinforcing particulate material.

In its method aspects, the present invention comprehends a method for deposition of metal upon a substrate which includes providing an apparatus containing an arc chamber for confining a D.C. electrical arc discharge, the arc chamber containing an outlet orifice in fluid communication with a deposition chamber having a deposition opening in alignment with the orifice for depositing metal droplets on a coatable substrate; passing an ionizable inert gas into the arc chamber; continually passing a metal wire into the arc chamber in alignment with the orifice, with the leading end of the wire spaced from the orifice and proximate to the orifice; imposing a first electrical charge on the leading end of the metal wire and a second electrical charge on the edge of the orifice, the first and second charges having opposite polarities, to thereby cause D.C. arcing between the wire leading end and the orifice edge sufficient to produce droplets of molten metal from the wire; passing metal droplets and ionized inert gas through the orifice and into the deposition chamber; exposing a coatable substrate at the deposition opening; and passing metal droplets through the deposition chamber and out the deposition opening to thereby coat the exposed substrate with metal droplets.

In its method aspects, the present invention further includes the foregoing method for depositing the metal upon the substrate wherein a second inert gas containing suspended reinforcing particulate material is passed into the deposition chamber under conditions sufficient to uniformly mix the suspended reinforcing particulate material and the metal droplets within the deposition chamber; and passing this uniform mixture through the deposition opening to thereby coat the exposed surface of the substrate with a uniform mixture of metal droplets and reinforcing particulate material.

A clearer understanding of the present invention will be obtained from the disclosure which follows when read in light of the accompanying drawing.

BRIEF DESCRIPTION OF THE DRAWING

The FIGURE is a simplified schematic representation of an embodiment of the inventive apparatus.

DESCRIPTION OF THE PREFERRED EMBODIMENTS

Referring now to the FIGURE, there is shown a gas-metal arc deposition apparatus 10 in accordance with this invention. The apparatus contains a water cooled torch barrel 11 of conventional design, such as a Cobramatic gas-metal arc torch barrel which is supplied by MK Products Inc. of Irvine, Calif. The torch barrel 11 includes a contact tip 12 of copper which feeds a metal wire 13 for arc deposition. The metal wire 13 provides a wire anode which is fed through the torch barrel 11 and the contact tip 12 from a standard welding wire feeder 52 at a constant rate. A nonconductive gas cup formed by a cylindrical wall 14 and an annular floor 15, surrounds the copper contact tip 12 to form a gas cup chamber 16 for an ionizable gas. The cylindrical wall 14 and the annular floor 15 may be of boron nitrite which has a high electrical resistance. The inert gas enters the torch barrel 11 via a feed conduit 54 and passes through the torch barrel by means of an internal conduit, not shown, to thereby supply the inert gas into the gas cup chamber 16. The inert gas conventionally is helium or argon, which is discharged from the gas cup chamber 16 into an arc chamber 23 via a plurality of passageways 17 in the annular floor 15. The wall 14 of the gas cup contains an annular groove which holds an O-ring 18 for sealing the surface of the torch barrel 11 with the cylindrical wall 14 in order to provide that the inert gas does not leak from the chamber 16.

As seen in the FIGURE, an annular main body member 21 surrounds the major portion of the sides of the annular floor 15 of the gas cup. The main body member 21 also encompasses an arc chamber body member 24. The inner wall of main body member 21 contains three circular recesses for holding O-rings 22, 28 and 29 for sealing main body member 21 to the annular floor 15 and the arc chamber body member 24. The energizable arc chamber 23 is defined by the upper portion of the arc chamber body member 24. The arc chamber body member 24 is preferably made of copper.

The arc chamber floor contains an orifice opening 25, the copper edge of which is energizable to act as a cathode for creating the discharge of electrical arcs 26 between the orifice 25 and the wire anode 13. A conventional D.C. power source 47 provides an electrical charge via electrical conductor 48 to the torch barrel 11 for energizing the leading end of wire 13 at the contact tip 12. A second electrical conductor 49 passes through the main body member 21 to energize the arc chamber body member 24 in order to provide a charge of opposite polarity at the edge of the orifice 25. Generally, as previously noted, the wire 13 is the anode and the edge of the orifice 25 is the cathode for causing the arcs 26 to melt the tip or leading end of the wire 13. This causes a plurality of molten metal droplets 27 to fall through the orifice 25 and into a deposition chamber 39.

Because the arcing between the anode of the leading end of the wire 13 and the cathode of the edge of the orifice 25 causes heat to be generated, a cooling means is provided in order to control the temperature. This cooling means includes a cooling fluid inlet passageway 30 in the main body member 21. The cooling fluid passageway 30 feeds cooling fluid, typically water, into an annular cooling chamber 32 which is confined between the inner surface of the main body member 21 and the outer surface of the arc chamber body member 24. Cooling fluid which has been heated by the arc chamber is passed from annular cooling chamber 32 of the main body member 21 via a cooling fluid outlet passageway 31.

Below the main body member 21 and the arc chamber body member 24 there is an annular shielding gas manifold 34 which contains an inlet gas passageway 35. The inlet gas passageway 35 feeds an inert gas, such as argon or helium, into an annular shielding gas chamber 36. A plurality of ports 37 which are contained in a deposition chamber body member 40 allow the inert gas to pass into the deposition chamber 39. The inert gas passes into the deposition chamber 39 in order to provide a non-oxidizing atmosphere within the chamber so that the metal droplets will not be converted to the metal oxide form.

The deposition chamber 39 has a throat 41 which has an inlet at the orifice 25 and an outlet adjacent the inert gas input ports 37. The throat 41 has a ceramic liner 42 which is a nonconductive liner so that the arcs which are occurring within the arc chamber 23 will not jump out of the arc chamber through the orifice and strike on the sides of the throat. It will be seen that the bottom of the deposition chamber 39 is open to thereby provide a deposition opening. As shown in the Figure, a substrate 43 may be passed across the deposition opening at the bottom of the deposition chamber 39 so that a coating 44 is placed upon the surface of the substrate 43. As shown, the substrate 43 moves in the direction indicated by the arrow 56. In order to provide for clearance between the coating and the deposition chamber body member 40, it will be seen that the left side of the deposition chamber body member 40 is shorter than the right side of the deposition chamber body member. By feeding the wire 13 at a predetermined constant rate and moving the substrate 43 at a constant speed, a uniform coating thickness for the coating 44 is achieved.

In those operations where it is desired not to coat the substrate with a metal or metal alloy, but to provide a coating of a metal matrix composite, the inert gas which enters the gas inlet passageway 35 in the annular shielding gas manifold 34 will contain a suspension of reinforcement particulate material, which may be formed of particles, whiskers, chopped fibers, or a mixture thereof. In such an operation, the inert gas with the suspended reinforcement particulate material is discharged through the plurality of ports 37 around the outlet of the throat 41 in such a manner that the particles 38 of the reinforcement particulate material will be focused toward the center or axis of the deposition chamber where they will meet the molten droplets 27 of the metal which enters the deposition chamber via the orifice 25 and the throat 41. It will be seen in the Figure that the inlet ports 37 are angled toward the axis of the deposition chamber to thereby focus the particles 38 toward the axis where they can combine with the falling molten metal droplets 27 to form a uniform mixture. In such an operation, the coating 44 will be a metal matrix composite having a uniform thickness and a uniform composition, provided that the metal wire 13 is fed into the arc chamber at a predetermined constant rate, the reinforcing particulate material 38 is fed into the deposition chamber at a constant rate, and the substrate moves across the deposition opening at a constant rate.

In the foregoing description, the substrate 43 was moved to the left in order to provide for the coating 44. In an alternate operation, the substrate may be stationary. In this alternate embodiment, the gas metal arc deposition apparatus itself is moved in order to provide for a continuous coating operation. The movement of the gas metal arc deposition apparatus will be toward the right as indicated by the arrow 57, with the substrate 43 being situated in a stationary position.

OPERATING EXAMPLES

Experimental work was done with an apparatus in accordance with the foregoing description and Figure. The torch barrel, wire feeder, and contact tip were commercially obtained as a Cobramatic gas-metal arc torch barrel and wire feeder which was supplied by MK Products, Inc. of Irvine, Calif. The D.C. power source was supplied by Robot Arc, Inc. of Berlin Heights, Ohio., The other elements of the inventive apparatus were fabricated in-house.

The electrical parameters required to produce stable melting in the apparatus are summarized in Table 1. It was found that maintaining the arc of the orifice cathode within the gas cup chamber 16 depends upon the correct balance of pressures above and below the orifice. This pressure balance was achieved by regulating relative gas flows through the torch barrel 11 and through the inlet gas ports 37. The substrate samples were water-cooled copper or steel, and they were moved beneath the deposition opening of the apparatus on a motorized track. Both flat substrates and linear molds of about 1 square centimeter in cross-section and 15 centimeters in length were used.

TABLE 1

| | Operating Parameters Aluminum Wire Type | | |
|---|---|---|---|
| | 5356 | 4043 | 1100 |
| Nominal composition, wt. % | Al-5% Mg | Al-5% Si | 99.0 Al |
| Wire diameter, mm | 1.59 | 0.9, 1.14 | 1.2 |
| Voltage, V | 23-26 | 29-32 | 29-32 |
| Current, A | 190-230 | 190-230 | 190-230 |
| Distance of contact tip to Orifice, mm | 19.1 | 19.1 | 19.1 |

Silicon carbide particles nominally 7 μm in diameter, or whiskers, nominally 2 μm in diameter by 100 μm long, were placed in a cylindrical container approximately 8 centimeters in diameter by 15 centimeters high through which argon was blown. This stirred the particles and entrained them in the exiting gas. This gas was introduced either through the shielding gas ports 37 below the cathode orifice, or separately a short distance above the substrate, near the metal droplet impact point. The arc was started with a small piece of thin aluminum plate across the orifice which was vaporized upon contact by an aluminum wire 13 passing from the contact tip 12. This initiated an arc which continued between the wire 13 and the edge of the orifice 25.

There were several safety considerations in doing this work. As mentioned previously, the amount of finely divided aluminum present in this process is relatively small, so that the concentration of aluminum droplets is far below the flammability limits and is thus not a problem, particularly since the droplets are falling in an atmosphere of inert gas. Efforts were made, however, to avoid environmental contamination by silicon carbide because of the health hazards associated with small particles of silicon carbide. All runs with silicon carbide were made in a chamber with a strong negative pressure and a direct exhaust, and all surfaces of the equipment were wiped down before disassembling.

A number of materials were produced. Aluminum alloys 1100, 4043, and 5356 were sprayed without reinforcement particulate matter in order to evaluate operating characteristics, porosity, and mechanical properties with respect to similar wrought and cast aluminum alloys. Silicon carbide reinforcement was introduced by several methods to evaluate the uniformity and morphology of the reinforcement.

The products were evaluated in several ways. The density, a measure of the porosity expected in spray processes, was determined, after the machining off of surface irregularities, by immersion weighing. Strength and ductility of pure metal specimens were evaluated with subsize ASTM tensile specimens machined from deposits. Insufficient homogeneity was achieved with composite specimens to produce meaningful property measurements. The grain size was measured by the line intercept method on micrographs. The volume fraction of silicon carbide was determined automatically, also from micrographs (Quantimet). The distribution and morphology of the silicon carbide reinforcement was evaluated with optical metallography.

When good shielding by the inert gas was obtained, the surface finish of the deposited materials was smooth and showed no gross oxidation. Densities were usually above 90% theoretical, and often above 95%. When metal matrix composite structures were produced, the distribution of reinforcement particles was uneven, showing regions of desirable volume fractions of particles and desirable arrangements of whiskers, but also showing some regions with little or no silicon carbide. Regions of excessive silicon carbide volume fraction were not observed. This uneven distribution of the silicon carbide was due to misoperation of the system for suspending the silicon carbide particles in the inert gas, thereby causing inert gas to occasionally enter the inventive apparatus without suspended silicon carbide particles or whiskers.

The grain size of the spray deposits range from 42 to 66 μm, depending upon the cooling conditions in the mold or substrate. Representative tensile properties of the pure metals are compared with those of similar wrought and cast alloys in Table 2. Note that the data for aluminum alloy 1100 are very similar for the wrought alloy and the alloy produced by the spray deposition process of this invention.

TABLE 2

| | Tensile Test Results | | |
|---|---|---|---|
| Material | Method of Production | UTS*, ksi | Elongation, % |
| 4043 | Spray deposition** | 23.1 | 4.5 |
| 4043 | Sand cast | 19 | 8*** |
| 4043 | Permanent mold | 23 | 10*** |
| 1100-0 | Wrought | 13 | 35*** |
| 1100 | Spray deposition** | 15 | 34 |

*Ultimate Tensile Strength, kip per sq. in.
**Process of this invention
***From the literature In general, the arc melting deposition process of this invention was stable, and runs of several minutes were attainable, with deliberate termination of the runs occurring as the end of the substrate approached. The occasional operating problems included clogging of the orifice, arc instabilities, and arc extinction due to gas flow imbalances. The only component showing substantial wear was, as might be expected, the cathode orifice. It was for this reason that the orifice was designed from the first as a simple replaceable component. The cathode orifice design was modified several times in the course of experimentation and worn spots were built up by welding. An optimized orifice cathode should last several hours without maintenance. As expected, proper shielding of the droplet stream and solidifying metal with inert gas is important in producing a good surface finish and low internal porosity.

The small scale laboratory apparatus of these experiments has produced aluminum/silicon carbide composites with a local volume fraction of silicon carbide exceeding 0.20. More research on the mechanism on reinforcement injection, incorporation, and distribution in the solidifying composite is needed before large scale homogeneous microstructures are produced. Future work on this process is expected to involve optimization of the reinforcement feeding system which was responsible for the inadequate silicon carbide distribution which was observed in these experiments.

The microstructure and mechanical properties obtained in unreinforced materials produced with this process are similar to those found in conventionally produced versions with the same alloys. With a high quality matrix and the ability to add variable amounts and kinds of reinforcement, the results of the experiments suggest that considerable microstructural control of metal matrix composites are possible with this method. The process may also be modified to construct near net shape parts or to join metal matrix composites by welding.

This process has several desirable attributes. Any metal, including very high temperature alloys, can be melted by the arc, and virtually any reinforcement particulate materials can be entrained in the shielding inert gas, thereby leading to a wide variety of composite materials. The process is applicable to any metal that can be made into wire form for use as the consumable anode electrode. Titanium, iron, steel, and other high temperature metals might be selected. Copper may be operable, but it would require high currents due to its high conductivity. Various ceramics including silicon carbide or powdered metals could be used as the particulate reinforcement component. The melting is more convenient in this process than with conventional melting methods, since the process can be turned on and off at will. The modified gas metal arc torch is compact, inexpensive, and controllable. Finally, because relatively large droplets of metal are being produced in an inert atmosphere, the pyrophoricity problems associated with finely divided aluminum are reduced.

Those skilled in the art may recognize that a related process includes plasma spraying where powdered materials are blown into a plasma generated by high voltage and are thereby melted to be deposited onto a substrate. The process of the present invention is different, however, since the electrode generating the arc or plasma is consumed itself, and becomes part of the deposition. Moreover, the powdered or particulate reinforcement material is introduced downstream of the plasma.

In light of the foregoing disclosure, further alternative embodiments of the inventive gas-metal arc deposition apparatus and method will undoubtedly suggest themselves to those skilled in the art. It is thus intended that the disclosure be taken as illustrative only, and that it not be construed in any limiting sense. Modifications and variations may be resorted to without departing from the spirit and the scope of this invention, and such modifications and variations are considered to be within the purview and the scope of the appended claims.

The embodiment of the invention in which an exclusive property or privilege is claimed is defined as follows:

1. A gas-metal arc deposition apparatus which comprises:

(a) an arc chamber body member defining an arc chamber for confining a D.C. electrical arc discharge, said arc chamber body member containing an orifice for discharging ionizable inert gas and molten metal droplets from said arc chamber;

(b) a deposition chamber body member defining a deposition chamber in fluid communication with said arc chamber at said arc chamber orifice;

(c) first means for introducing a first ionizable inert gas into said arc chamber;

(d) means for continuously introducing a metal wire into said arc chamber, said means introducing said wire in alignment with said orifice, spaced from said orifice, and proximate to said orifice;

(e) means for imposing a first electrical charge on the leading end of said metal wire introduced into said arc chamber, and for imposing a second electrical charge on the arc chamber body member at said orifice, said first and second charges having opposite polarities, to thereby cause arcing between said wire leading end and the edges of said orifice to produce droplets of molten metal from said wire leading end which pass with ionizable inert gas through said orifice and into said deposition chamber; and, (f) a deposition opening in said deposition chamber body member, spaced from said arc chamber orifice and in alignment therewith, for allowing metal droplets passing through said orifice and into said deposition chamber to coat the surface of a substrate exposed at said deposition opening.

2. A gas-metal arc deposition apparatus according to claim 1 wherein said arc chamber body member is enclosed in a main body member, said main body member contains an inner cooling chamber for cooling said arc chamber, and said main body member contains inlet and outlet fluid passageways for conveying cooling fluid to and from said inner cooling chamber.

3. A gas-metal arc deposition apparatus according to claim 2 wherein said arc chamber body member is an annular cylinder defining a cylindrical arc chamber and a central circular orifice, said main body member is an annular cylinder, and said inner cooling chamber is an annular chamber in said main body member adjacent the outer cylindrical wall of said arc chamber body member.

4. A gas-metal arc deposition apparatus according to claim 1 wherein said deposition chamber includes a chamber throat having a throat inlet at said arc chamber orifice and having a throat outlet for discharging first inert gas and molten metal droplets into said deposition chamber.

5. A gas-metal arc deposition apparatus according to claim 4 wherein said throat includes a nonconductive liner extending around the outside of said orifice and along the sidewall of said throat.

6. A gas-metal arc deposition apparatus according to claim 4 including second means for introducing a second inert gas into said deposition chamber adjacent said throat outlet.

7. A gas-metal arc deposition apparatus according to claim 6 further including means for supplying second inert gas containing suspended reinforcing particulate material, and further including said second gas introducing means positioned adjacent said throat outlet at an angle sufficient to provide that suspended particulate material in said second inert gas will join metal droplets exiting said throat outlet to provide a uniform mixture for coating said exposed substrate surface with a uniform coating of metal droplets and reinforcing particulate material.

8. A gas-metal arc deposition apparatus according to claim 6 wherein said second means for introducing inert gas includes at least one inert gas passageway positioned adjacent said throat outlet and angled inwardly toward the throat axis so that an input suspension of reinforcing particulate material in inert gas will merge with molten metal droplets entering said deposition chamber from said throat outlet to produce a mixture for coating the surface of a substrate exposed at said deposition opening.

9. A gas-metal arc deposition apparatus according to claim 1 including motive means for moving a substrate past said deposition opening for coating the surface of the moving substrate exposed to said deposition opening.

10. A gas-metal arc deposition apparatus according to claim 9 wherein said motive means moves said substrate in a continuous motion for uniformly coating said exposed substrate surface.

11. A gas-metal arc deposition apparatus according to claim 1 including motive means for moving said gas-metal arc deposition apparatus over a stationary substrate to coat a substrate surface exposed to said deposition opening.

12. A gas-metal arc deposition apparatus according to claim 11 wherein said motive means moves said apparatus in a continuous uniform motion for uniformly coating said exposed substrate surface.

13. A gas-metal arc deposition apparatus according to claim 1 including second means for introducing a second inert gas into said deposition chamber.

14. A gas-metal arc deposition apparatus according to claim 13 further including means for supplying second inert gas containing suspended reinforcing particulate material, and further including said second gas introducing means positioned to discharge inert gas and suspended reinforcing particulate material into said deposition chamber at an angle sufficient to provide that said suspended reinforcing particulate material entering said deposition chamber will join metal droplets entering said deposition chamber to provide a uniform mixture for coating an exposed substrate surface with a uniform coating of metal droplets and reinforcing particulate material.

15. A gas-metal arc deposition apparatus according to claim 1 wherein said means for introducing a metal wire into said arc chamber includes means for introducing said wire at a controlled predetermined rate.

16. A gas-metal arc deposition apparatus which comprises:

(a) an arc chamber body member defining an arc chamber for confining a D.C. electrical arc discharge, said arc chamber body member containing an orifice for discharging ionizable inert gas and molten metal droplets from said chamber;

(b) a deposition chamber body member defining a deposition chamber in fluid communication with said arc chamber at said arc chamber orifice;

(c) first means for introducing a first ionizable inert gas into said arc chamber;

(d) means for continuously introducing a metal wire into said arc chamber, said means introducing said wire in alignment with said orifice, spaced from said orifice, and proximate to said orifice;

(e) means for imposing a first electrical charge on the leading end of said metal wire introduced into said arc chamber, and for imposing a second electrical charge on the arc chamber body member at said orifice, said first and second charges having opposite polarities, to thereby cause arcing between said wire leading end and the edges of said orifice to produce droplets of molten metal from said wire leading end which pass with ionizable inert gas through said orifice and into said deposition chamber;

(f) a deposition opening in said deposition chamber body member, spaced from said arc chamber orifice and in alignment therewith, for allowing metal droplets passing through said orifice and into said deposition chamber to coat the surface of a substrate exposed at said deposition opening;

(g) means for supplying second inert gas containing suspended reinforcing particulate material to said deposition chamber; and, (h) second gas introducing means providing fluid communication between said supplying means and said deposition chamber, said second gas introducing means including at least one conduit passing through said deposition chamber body member at a location and with an orientation sufficient to cause suspended reinforcing particulate material to join with metal droplets entering said deposition chamber to provide a uniform mixture for coating a substrate surface exposed at said deposition opening.

17. A gas-metal arc deposition apparatus according to claim 16 wherein said arc chamber body member is enclosed in a main body member, said main body member contains an inner cooling chamber for cooling said arc chamber, and said main body member contains inlet and outlet fluid passageways for conveying cooling fluid to said inner cooling chamber.

18. A gas-metal arc deposition apparatus according to claim 17 wherein said arc chamber body member is an annular cylinder defining a cylindrical arc chamber and a central circular orifice, said main body member is an annular cylinder, and said inner cooling chamber is an annular chamber in said main body member adjacent the outer cylindrical wall of said arc chamber body member.

19. A gas-metal arc deposition apparatus according to claim 16 wherein said deposition chamber includes a chamber throat having a throat inlet at said arc chamber orifice and having a throat outlet for discharging first inert gas and molten metal droplets into said deposition chamber.

20. A gas-metal arc deposition apparatus according to claim 19 wherein said throat includes a nonconductive liner extending around the outside of said orifice and along the sidewall of said throat.

21. A gas-metal arc deposition apparatus according to claim 19 wherein said second gas introducing means is positioned adjacent said throat outlet.

22. A gas-metal arc deposition apparatus according to claim 19 wherein said second means for introducing inert gas includes a plurality of gas passageways positioned adjacent said throat outlet and angled inwardly toward the throat axis.

23. A gas-metal arc deposition apparatus according to claim 16 including motive means for moving a substrate past said deposition opening for coating the surface of the moving substrate exposed at said deposition opening.

24. A gas-metal arc deposition apparatus according to claim 23 wherein said motive means moves said substrate in a continuous motion for uniformly coating said exposed substrate surface.

25. A gas-metal arc deposition apparatus according to claim 16 including motive means for moving said gas-metal arc deposition apparatus over a stationary substrate to coat a substrate surface exposed at said deposition opening.

26. A gas-metal art deposition apparatus according to claim 25 wherein said motive means moves said apparatus in a continuous uniform motion for uniformly coating said exposed substrate surface.

27. A gas-metal arc deposition apparatus according to claim 16 wherein said means for introducing a metal wire into said arc chamber includes means for introducing said wire at a controlled predetermined rate.

* * * * *